US006237553B1

(12) United States Patent
Suzuki

(10) Patent No.: US 6,237,553 B1
(45) Date of Patent: May 29, 2001

(54) ARRANGEMENT FOR DRIVING VALVES

(75) Inventor: Ken Suzuki, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/558,018

(22) Filed: Apr. 25, 2000

(30) Foreign Application Priority Data

Apr. 28, 1999 (JP) ..... 11-121813

(51) Int. Cl.[7] ..... F01L 1/26; F01L 1/16

(52) U.S. Cl. ..... 123/90.22; 123/90.28; 123/90.4

(58) Field of Search ..... 123/90.22, 90.28, 123/90.39, 90.4, 90.48, 90.5

(56) References Cited

U.S. PATENT DOCUMENTS 5,410,995 * 5/1995 Bentz et al. ..... 123/90.22
5,626,110 * 5/1997 Regueiro ..... 123/90.22
5,699,762 * 12/1997 Horiuchi ..... 123/90.22
5,921,209 * 7/1999 Regueiro ..... 123/90.22

FOREIGN PATENT DOCUMENTS 2-126006 10/1990 (JP) .

* cited by examiner

*Primary Examiner*—Weilun Lo
(74) *Attorney, Agent, or Firm*—McCormick, Paulding & Huber LLP

(57) ABSTRACT

A valve drive arrangement for use in an engine having a pair of intake valves and a pair of exhaust valves for each cylinder. Each pair of intake valves are coupled to each other by a valve bridge and forced downwards simultaneously by a single rocker arm, and each pair of exhaust valves are coupled to each other by another valve bridge and forced downwards simultaneously by another single rocker arm. A contact member is rotatably provided on an upper surface of each valve bridge such that it contacts the associated rocker arm. The press center of the rocker arm to the associated contact member and center lines of the associated valves lie in a single plane. A rotation center of the associated contact member is offset from this single plane.

8 Claims, 3 Drawing Sheets

ARRANGEMENT FOR DRIVING VALVES

BACKGROUND OF THE INVENTION

1. Field of the Invention

The present invention relates to an arrangement for actuating valves employed in an internal combustion engine.

2. Description of the Related Art

A four-valve engine that has two intake valves and two exhaust valves per each cylinder is known in the art. In some of the four-valve engines, the two intake valves for each cylinder are bridged to each other by a valve bridge and the two exhaust valves are also bridged by another valve bridge. Upper surfaces of these valve bridges are pressed by ends of rocker arms respectively such that the two intake valves are forced downwards (or in a valve opening direction) simultaneously and the two exhaust valves are also forced downwards (or in a valve opening direction) simultaneously.

The end of each rocker arm performs a pivot movement about an associated shaft. Thus, the rocker arm end slides on the upper surface of the valve bridge while the rocker arm pushes the valve bridge downwards. This sliding movement of the rocker arm takes place in a certain small area on the valve bridge upper surface. Thus, this area is only subjected to wear. In order to prevent this local wear, Japanese Utility Model Application Laid Open Publication No. 2-126006 provides an improvement. Specifically, a rotatable chip member is located on the valve bridge top surface such that it contacts the rocker arm. Since the chip member rotates, the contact between the rocker arm and chip member varies. Accordingly, the wear of the chip member is less concentrated.

In this improvement, however, the pivot movement of the rocker arm draws an arcuate orbit that passes through a rotation center of the chip member when it slides in contact with the chip member. As a result, the rocker arm cannot apply a sufficiently large rotational moment onto the chip member due to the drag between the rocker arm and chip member. Thus, the chip member does not rotate very much, and the local wear is not prevented as much as expected.

Another known arrangement for actuating valves of an engine is an over head cam arrangement that allows a camshaft to directly contact and drive the intake and exhaust valves. A rotatable lifter is sometimes located at a top of each valve stem such that it contacts the associated cam. By offsetting the lifter center from the cam contact point (press center), the cam can apply a rotational moment to the lifter and causes the lifter to rotate. The drag exerted by the cam in this case positively forces the lifter to rotate so that the wear is not concentrated in a particular area.

This arrangement may be utilized in the engine having rocker arms. Specifically, the rocker arm contact point (press center) may be offset from the chip member rotation center. However, the center lines of the two intake valves (or exhaust valves) lie in the same plane as the chip member center. Thus, if the rocker arm press center were offset relative to this plane, a couple of force would act on the entire valve bridge including the chip member from the rocker arm and valves. This would cause lateral pressure to apply between the valve bridge and intake valves (or exhaust valves). If large lateral pressure were generated, gall would occur.

SUMMARY OF THE INVENTION

An object of the present invention is to overcome the above described problems.

According to one aspect of the present invention, there is provided a valve drive arrangement for use in an engine having a pair of intake valves and a pair of exhaust valves for each cylinder, with each pair of intake valves being coupled to each other by a valve bridge and forced downwards simultaneously by a single rocker arm, and each pair of exhaust valves being coupled to each other by another valve bridge and forced downwards simultaneously by another single rocker arm, characterized in that a contact member is rotatably provided on an upper surface of each valve bridge such that it contacts the associated rocker arm, the press center (contact point) of the rocker arm to the associated contact member and center lines of the associated valves lie in a single plane, and a rotation center of the associated contact member is offset from this single plane.

For the sake of easier understanding, the following description only deals with the two intake valves for a particular cylinder. Since the press center of the rocker arm to the contact member and the center lines of the intake valves lie in the same plane, no couple of force acts on the valve bridge including the contact member. Accordingly, no lateral pressure acts between the valve bridge and the valves. Thus, gall is prevented. Further, since the press center of the rocker arm to the contact member does not coincide with the rotation center of the contact member, the rotation of the contact member is promoted. Accordingly, local wear does not occur in the contact member.

Each contact member may have a relatively large head and a stem extending from the head, and the stem may be rotatably received in a recess formed in the associated valve bridge. Each rocker arm may have a chip made from a wear-resistive material, and the chip may contact the head of the associated contact member. The stem of each contact member may be loosely fitted in the recess of the associated valve bridge. Each contact member may be made from a wear-resistive material. No bridge guide is required for supporting movement of the valve bridge.

DETAILED DESCRIPTION OF THE INVENTION

Now, an embodiment of the present invention will be described in reference to the accompanying drawings.

Figure 3:
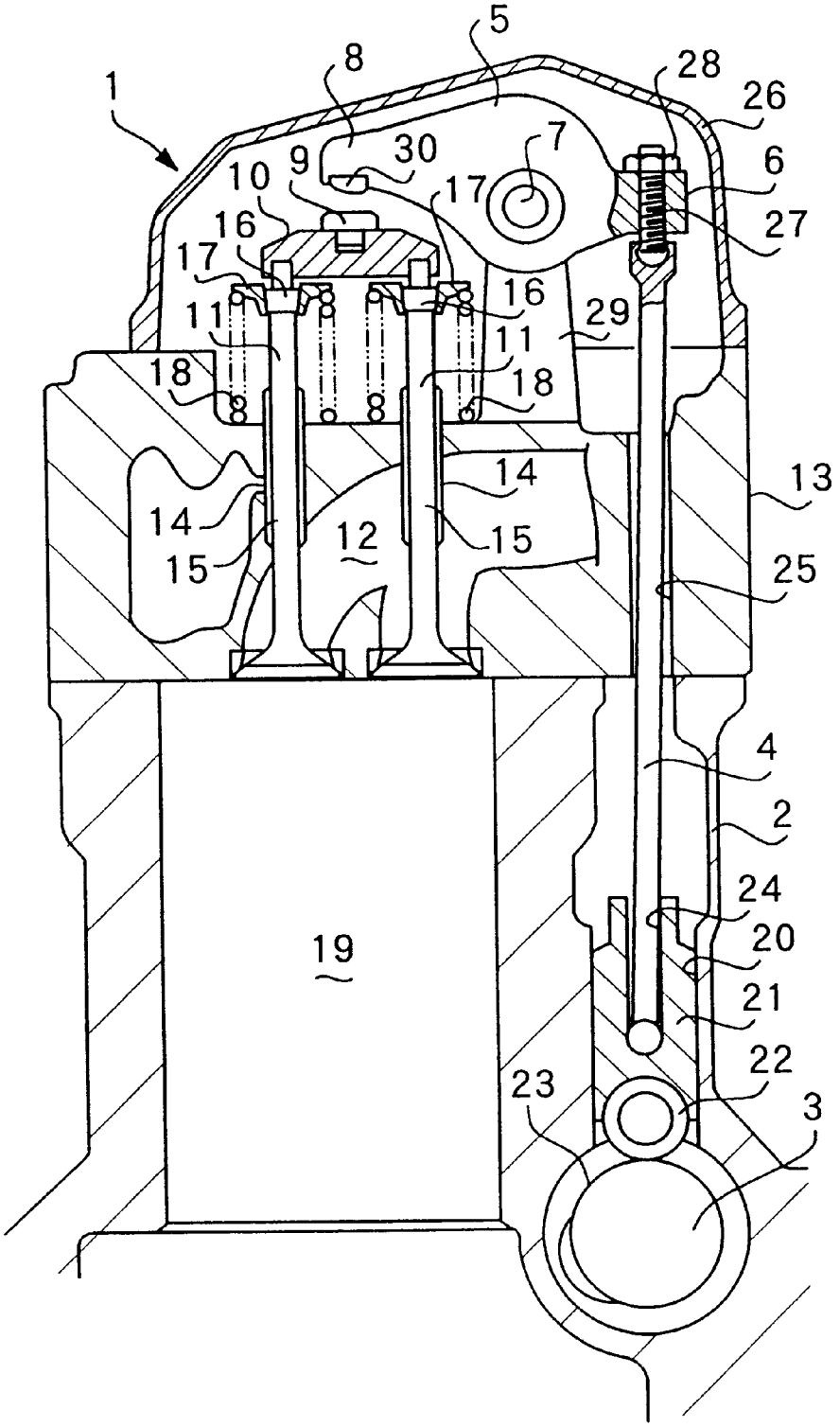
FIG. 3 illustrates a longitudinal cross sectional view of the entire valve drive arrangement according to the present invention.

Referring first to FIG. 3, illustrated is part of an engine 1 that incorporates a valve drive arrangement of the invention. This engine 1 is an OHV (overhead valve) engine, and has a camshaft 3 that rotates synchronously with a crankshaft (not shown). The engine 1 has at least one cylinder bore 19, but only one cylinder bore is illustrated and described below. The camshaft 3 is positioned at an approximate midpoint in the height direction of a cylinder block 2. As the camshaft 3 rotates, a push rod 4 is moved upwards, and in turn a driven end 6 of a rocker arm 5 is forced up. As a result, the rocker arm 5 rotates about its support shaft 5 counterclockwise, and a drive end 8 of the rocker arm 5 forces a cap (contact member) 9 and a valve bridge 10 downwards. Downward movement of the valve bridge 10 causes two intake valves 11 to ascend simultaneously, thereby opening two downstream end openings of an intake port 12.

The engine 1 is a four-valve engine, that has two intake valves 11 and two exhaust valves (not shown) for each cylinder. The intake valves 11 are only dealt with in the following description, but the same story applies to the exhaust valves. The two intake valves 11 are located close to each other, and their valve stems 15 extend through valve guides 14 secured to a cylinder head 13. Each valve stem 15 has a cotter 16 near its upper end, and a retainer 17 is received on the cotter 16. Each retainer 17 is forced upwards in a valve closing direction by a force from an associated valve spring 18, so that the associated valve 11 is always biased toward a closed position.

The cylinder block 2 has at lest one bore 19 and a sleeve hole 20 in parallel to the bore 19. The sleeve hole 20 receives a piston sleeve 21 in a sidable manner. A roller 22 is rotatably mounted on a lower end of the piston sleeve 21. The roller 22 is kept in contact with a cam 23 of the camshaft 3 while the cam 23 (or camshaft 3) is rotating. The piston sleeve 21 has a push rod hole 24 that extends downwards along the center line of the piston sleeve midway. A lower part of the push rod 4 is received in the push rod hole 24. The push rod 4 extends upwards through a through hole 25 formed in the cylinder head 13, and its upper end abuts (or engages with) an adjust screw 27 in a head cover 26. The adjust screw 27 is threaded into the driven end 6 of the rocker arm 5 and fixed by a lock nut 28. A lower end of the adjust screw 27 has a spherical shape and the mating upper end of the push rod 4 has a complemented shape to receive the adjust screw lower end, like a ball-and-socket joint. The lower end of the push rod 4 also has a spherical shape.

The shaft 7 of the rocker arm 5 is supported by a pair of bosses 29 (only one is shown) erected from the cylinder head 13. A contact chip 30 made from a wear-resistive metal is embedded in a lower face of the drive end 8 of the rocker arm 5. This chip 30 contacts and slides on the cap 9. When the valves 11 are in a closed position, the chip 30 is situated above the cap 9 as illustrated.

Figure 1:
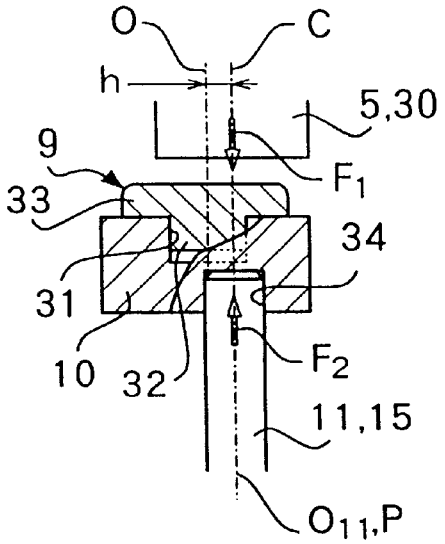
FIG. 1 illustrates a fragmentary longitudinal cross sectional view of a valve drive arrangement according to the present invention.

As illustrated in FIG. 1, the cap 9 is rotatably received in a recess 31 formed in the upper surface of the valve bridge 10. Specifically, the cap 9 includes a stem portion 32 of circular cross section to fit in the recess 31, and a contact portion or head 33 on the step portion having a larger circular cross section. A lower face of the contact portion 33 or the shoulder portion of the cap 9 seats on the top surface of the valve bridge 10. The stem portion 32 is coaxial to the head portion 33. The cap 9 is made from a relatively hard and wear-resistive metal. The cap 9 is rotatable about its center axis.

Figure 4:
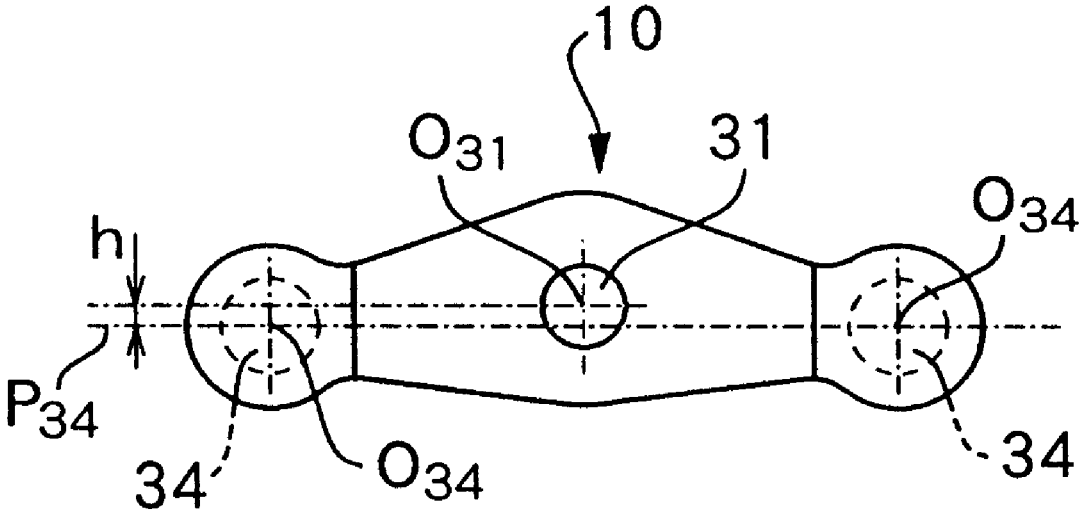
FIG. 4 illustrates a plan view of a valve bridge used in the valve drive arrangement shown in FIG. 3.

Referring now to FIG. 4, the valve bridge 10 has downwardly directed recesses 34 near its longitudinal ends such that these recesses 34 receive the upper ends of the valve stems 15 respectively (FIG. 3). Accordingly, the valve bridge 10 spans the two intake valves 11 as shown in FIG. 3. In the illustrated embodiment, the cap 9, valve bridge 10 and intake valves 11 are assembled by means of manual insertion or fitting only and they are removable from each other easily. Therefore, assembling, disassembling, inspection and repair of the cap 9, valve bridge 10 and intake valves 11 are simplified.

As illustrated in FIG. 4, the center $O_{31}$ of the center recess 31 of the valve bridge 10 is offset from a plane $P_{34}$ including the centers $O_{34}$ of the end recesses 34 by an amount of "h". This offsetting is also understood from FIG. 1, in which the center O of the cap 9 is offset from the plane P including the centers $O_{11}$ of the intake valves 11 by the amount of "h".

As illustrated in FIG. 4, the upper center recess 31 of the valve bridge 10 is formed at a mid point between the lower end recesses 34. As shown in FIG. 3, the rocker arm 5 pushes the cap 9 and valve bridge 10 downwards at a mid point between the two intake valves 11.

The rocker arm 5 has a press center (contact point) C, which is the center in the width direction of the chip 30. The press center C is included in the plane P. In other words, the press center C of the rocker arm 5 and the centers $O_{11}$ of the intake valves 11 lie in the same plane P.

Now, an operation of the valve drive mechanism of the invention will be described.

Referring to FIG. 3, as the rocker arm 5 is pushed upwards by the push rod 4 and caused to nod about the shaft 7, the chip 30 descends onto the cap 9 while it is drawing an arc. The chip 30 then slides on the cap 9 while it is forcing the cap 9 and associated parts downwards. This causes the two intake valves 11 to move downwards simultaneously, thereby opening the outlets of the intake port 12.

As shown in FIG. 1, since the press center C of the rocker arm 5 and the centers $O_{11}$ of the intake valves 11 lie in the same plane P, a couple of force does not act on the valve bridge 10 including the cap 9. Consequently, no lateral pressure is generated between the valve bridge 10 and each intake valve 11. Accordingly, gall is prevented. A downward force $F_1$ is applied onto the valve bridge 10 from the rocker arm 5 and a pair of upward counter forces $F_2$ are applied to the valve bridge 10 from the valve stems 15, but these forces $F_1$ and $F_2$ act in the same plane P so that no couple of force is created. Thus, there is no component of force that intends to tilt the valve stems 15 whereby no lateral pressure is generated and no gall occurs. The intake valves 11 are therefore accurately closed and opened at appropriate timing.

Figure 2:
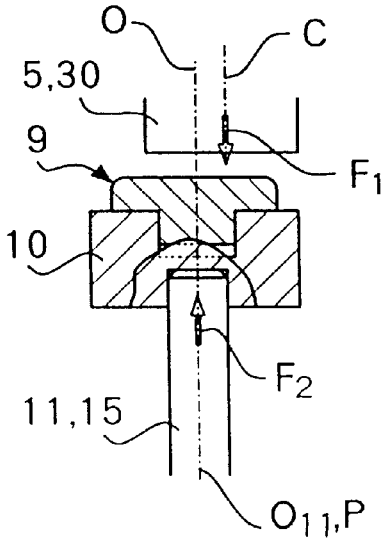
FIG. 2 PRIOR ART
FIG. 2 illustrates a fragmentary longitudinal cross sectional view of a valve drive arrangement according to a prior art.

Unlike the present invention, if the press center C were offset from the plane P, as shown in FIG. 2, the forces $F_1$ and $F_2$ would generate a couple of force to the valve bridge 10 and therefore the lateral pressure and gall would be caused. This is the drawback of the conventional arrangement. The valve drive arrangement of the invention can overcome this shortcoming.

In the illustrated embodiment, the rotation center O of the cap 9 is offset from the plane P, i.e., it is offset from the press center C of the rocker arm 5. Thus, the chip 30 of the rocker arm 5 slides on the cap 9 at a position deviated slightly outwards from the rotation center O of the cap 9. This creates a drag, and this drag efficiently applies a moment of rotation to the cap 9, thereby positively causing the cap 9 to rotate. Rotation of the cap 9 prevents local wear of the cap.

In the conventional arrangement shown in FIG. 2, the press center C of the rocker arm 5 is offset from the rotation center O of the cap 9 so that the cap 9 may be rotated positively. However, the cap rotation center O exists in the plane P so that the rocker arm press center C does not coincide to the plane P. This raises a problem of lateral pressure and gall. In view of this, the present invention provides an arrangement that can accomplish both promotion of rotation of the cap 9 and prevention of lateral pressure and gall.

In general, a bridge guide is provided between the intake valves 11 for supporting up and down movements of the valve bridge. However, the illustrated arrangement does not have it. Accordingly, the distance between the intake valves 11 can be reduced and the engine 1 can be designed to be compact. If there were a bridge guide, a couple of force, if generated, would be born by the bridge guide, and therefore no serious problem would occur. Without a bridge guide, however, a couple of force would be born by intake valves 11 directly. This would cause gall. The present invention prevents occurrence of a couple of force so that the bridge guide can be dispensed with. As a result, a compact engine can be made.

It should be noted that the present invention is not limited to the illustrated and described arrangement. For example, the present invention is applicable to DOHC (double overhead camshaft) engines, and engines other than a four-valve engine. Further, the contact member and valve bridge may have other configurations.

The illustrated and described valve drive arrangement is disclosed in Japanese Patent Application No. 11-121813 filed on Apr. 28, 1999, the instant application claims priority of this Japanese Patent Application, and the entire disclosure thereof is incorporated herein by reference.

What is claimed is:

1. An arrangement for driving a plurality of valves of an engine, comprising:

at least one valve bridge for at least one pair of valves, each valve bridge coupling each pair of valves;

at least one rocker arm, each rocker arm being associated with each valve bridge for forcing the pair of valves coupled by the each valve bridge in a valve opening direction simultaneously; and at least one contact member, each contact member being rotatably located on an upper face of each valve bridge such that it contacts the associated rocker arm, with a press center of each rocker arm to the associated contact member and center lines of the associated valves lying in a single plane, and a rotation center of the associated contact member being offset from the single plane.

2. The arrangement for driving a plurality of valves according to claim 1, wherein the plurality of valves include at least one pair of intake valves and at least one pair of exhaust valves.

3. The arrangement for driving a plurality of valves according to claim 1, wherein each contact member has a head and a stem extending from the head, and the stem is rotatably received in a recess formed in the associated valve bridge.

4. The arrangement for driving a plurality of valves according to claim 1, wherein each rocker arm has a chip made from a wear-resistive material, and the chip contacts the associated contact member.

5. The arrangement for driving a plurality of valves according to claim 3, wherein each rocker arm has a chip made from a wear-resistive material, and the chip contacts the head of the associated contact member.

6. The arrangement for driving a plurality of valves according to claim 3, wherein the stem of each contact member is loosely fitted in the recess of the associated valve bridge.

7. The arrangement for driving a plurality of valves according to claim 3, wherein each contact member is made from a wear-resistive material.

8. The arrangement for driving a plurality of valves according to claim 1, wherein bridge guides are not provided for supporting movement of the valve bridge.

* * * * *